US006899027B2

(12) United States Patent
Kersch

(10) Patent No.: US 6,899,027 B2
(45) Date of Patent: May 31, 2005

(54) METHOD AND APPARATUS FOR PREVENTING MACHINE DAMAGE

(75) Inventor: Robert Kersch, Dasing (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 290 days.

(21) Appl. No.: 09/870,804

(22) Filed: May 31, 2001

(65) Prior Publication Data

US 2001/0047733 A1 Dec. 6, 2001

(30) Foreign Application Priority Data

Jun. 2, 2000 (DE) ..... 100 27 441

(51) Int. Cl.[7] ..... B41F 33/18
(52) U.S. Cl. ..... 101/228; 101/484; 226/11
(58) Field of Search ..... 101/228, 484, 101/253, DIG. 42, 219, 242, 233, 275, 352, 492, 417; 226/11

(56) References Cited

U.S. PATENT DOCUMENTS

| | | | | |
|---|---|---|---|---|
| 4,039,914 A | * | 8/1977 | Steigerwald et al. | 318/375 |
| 4,417,516 A | * | 11/1983 | Fischer | 101/181 |
| 4,750,659 A | * | 6/1988 | Maier et al. | 226/92 |
| 4,777,420 A | | 10/1988 | Dadpey | |
| 4,966,074 A | * | 10/1990 | Aldrich, Jr. | 101/177 |
| 5,063,845 A | * | 11/1991 | Perretta | 101/484 |
| 5,188,028 A | * | 2/1993 | Reichel | 101/228 |
| 5,190,201 A | * | 3/1993 | Briggs | 226/1 |
| 5,355,742 A | | 10/1994 | Herrmann | 74/409 |
| 5,421,258 A | * | 6/1995 | Marozzi et al. | 101/228 |
| 5,588,224 A | * | 12/1996 | Gianforte et al. | 34/447 |
| 5,694,849 A | | 12/1997 | Wehle | |
| 5,810,235 A | | 9/1998 | Hoynant et al. | 226/1 |
| 5,820,065 A | | 10/1998 | Altosaar | |
| 5,901,647 A | | 5/1999 | Kohlmann | 101/216 |
| 5,970,871 A | * | 10/1999 | Andres | 101/180 |
| 5,988,063 A | * | 11/1999 | Brandenburg et al. | 101/219 |
| 6,032,579 A | * | 3/2000 | Richards | 101/219 |
| 6,106,177 A | * | 8/2000 | Siegl et al. | 400/618 |
| 6,262,555 B1 | * | 7/2001 | Hammond et al. | 318/759 |
| 6,334,389 B1 | * | 1/2002 | Fischer | 101/216 |

FOREIGN PATENT DOCUMENTS

| | | | |
|---|---|---|---|
| DE | 4138479 A1 * | 6/1993 | B41F/13/00 |
| DE | 197 22 243 | 12/1999 | |
| GB | 2 337 484 | 11/1999 | |
| JP | 05-213505 | 8/1993 | B65H/23/188 |
| JP | 11-010836 | 1/1999 | B41F/33/12 |
| JP | 11-334042 | 12/1999 | B41F/33/08 |

OTHER PUBLICATIONS

Patent Abstracts of Japan, 05–213505, Aug. 1993, "Roller Drive Control Method", Inventor: Ikeguchi Masao.

Patent Abstracts of Japan, 11–010836, Jan. 1999, "Stop Controller For Printing Machine", Inventor: Kamata Yoji et al.

Patent Abstracts of Japan, 11–334042, Dec. 1999, Rotary Press Connection Method:, Inventor: Mori Takashi.

* cited by examiner

*Primary Examiner*—Daniel J. Colilla
(74) *Attorney, Agent, or Firm*—Cohen, Pontani, Lieberman & Pavane

(57) ABSTRACT

In a web-fed rotary printing machine having a plurality of cylinders rolling on one another, each cylinder is driven by a respective drive motor, and a control device synchronizes the motors to run at the same speed. The control device has stored therein a control program which can be activated in the event of a web break. The control program has an emergency stop ramp which brakes the motors to a standstill by jerked stop, preferably within five revolutions, the program driving the motors along the stop ramp in the event of a web break.

15 Claims, 1 Drawing Sheet

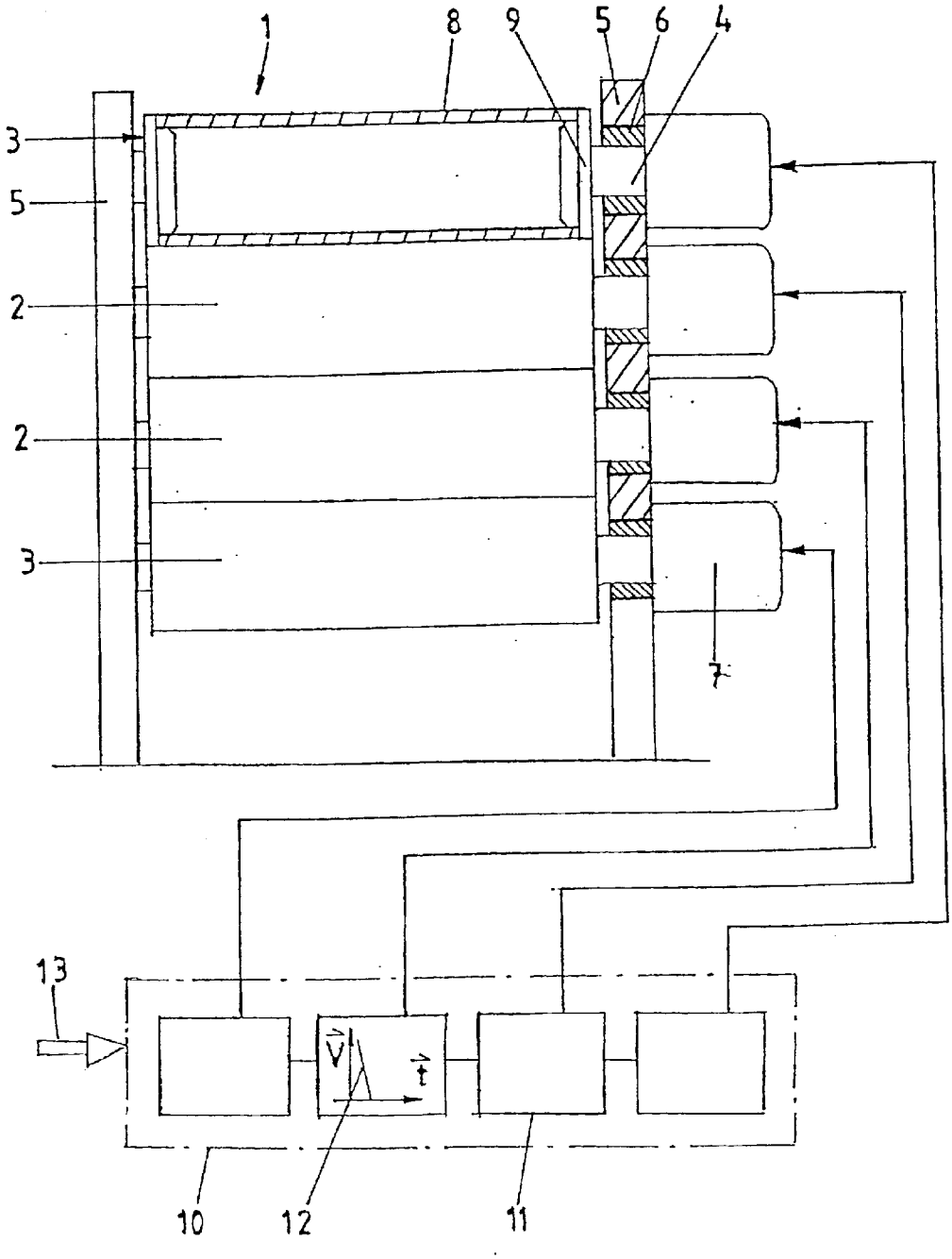
1
8
9
5
6
4
3
5
2
2
3
7
13
$\vec{V}$
$\vec{t}$
10
12
11

METHOD AND APPARATUS FOR PREVENTING MACHINE DAMAGE

BACKGROUND OF THE INVENTION

1. Field of the Invention

The invention relates to a method and an apparatus for preventing machine damage in the event of a web break in web-fed rotary printing machines having a plurality of cylinders rolling on one another.

2. Description of the Related Art

In the event of a web break, there is the risk that the printing-material web, which loses tension because of the web break, remains stuck to a transfer cylinder because of the adhesive effect of the fresh printing ink and is therefore wound up on the said cylinder. In order to avoid damage caused by this to the rubber blankets and/or the cylinder bearings, in the event of a web break the cylinders are brought very quickly into the print-off position. In addition, use is made of knock-off or catching devices, as they are known, by means of which the free end of a torn printing-material web is cut or caught and wound up. Transferring the cylinders rapidly into the print-off position is undesirable, since this can cause further web breaks. In addition, the result may be impacts on the drive devices. The use of knock-off and catching devices requires a high outlay on their provision and requires a great deal of space.

SUMMARY OF THE INVENTION

On this basis, it is therefore the object of the present invention to improve a method and an apparatus of the type mentioned at the beginning with simple and cost-effective means in such a way that high reliability can be achieved with little outlay whilst avoiding the disadvantages outlined above.

This object is achieved, in a web-fed rotary printing machine having a plurality of cylinders rolling on one another, by providing a plurality of motors assigned to the cylinders, which motors can be synchronized by means of an associated control device and which, in the event of a web break, can be braked abruptly to a standstill, at least within a few revolutions. To this end, the control device provided for synchronizing the motors contains a control program which can be activated in the event of a web break and has a steep emergency stop ramp which leads to a standstill, at least within a few revolutions. By means of this program, in the event of a web break, the motors are driven so that they are braked abruptly along the emergency stop ramp.

Since a plurality of motors are assigned to the cylinders and drive the cylinders directly or via a short layshaft, the result is comparatively small rotating masses. It is therefore possible to brake the machine to a standstill within one revolution or a few revolutions without causing other machine damage. Because of this abrupt braking, no layers of web or only a few layers of web are drawn into a press nip and possibly wound onto a transfer cylinder. The cylinders can therefore be left in the print-on position, nevertheless, damage to the rubber blankets and/or the cylinder bearings is not to be feared. The use of knock-off and/or catching devices can advantageously be dispensed with entirely, which facilitates and shortens the threading of the web after a web break and subsequent starting of the machine.

Advantageous refinements include constructing the cylinders as built-up cylinders with a hollow centre part. This results in a particularly low rotating mass.

The motors are preferably induction motors. Motors of this type are advantageously not susceptible to overload. It is therefore possible for the emergency stop ramp to run so steeply that the motors are operated in the overload range, at least for some time, which assists rapid braking.

In a further development of the invention, the effective direction of the motor torque can be reversed for the purpose of braking, i.e. the motors are simply changed over to reverse as a result of braking. This does not mean a reversal of the direction of rotation but merely the action of the motor torque as a braking torque counter to the direction of rotation of the motor down to a standstill. In this case, for the purpose of braking, the motors are subjected to the torque acting in a predefined reverse direction counter to the original direction of rotation.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The sole FIGURE is a schematic view of a printing unit in a web-fed rotary printing machine with directly driven cylinders and associated control device.

DETAILED DESCRIPTION OF THE PRESENTLY PREFERRED EMBODIMENTS

The construction and mode of action of web-fed rotary printing machines are known per se and therefore do not require any more detailed explanation in the present connection. The printing unit 1 on which the drawing is based and belonging to a web-fed rotary printing machine contains a double printing unit having two transfer cylinders 2 which roll on each other and are provided with rubber blankets or rubber sleeves and with which a plate cylinder 3 is associated in each case. The printing-material web to be printed here but not specifically illustrated is led through between the transfer cylinders 2. The cylinders 2, 3 are provided with lateral bearing journals 4, which are mounted in eccentric bushes 6 arranged in side frame walls 5. By rotating the eccentric bushes 6, the cylinders 2, 3 can be set against each other or away from each other.

Each cylinder 2, 3 is assigned its own drive motor 7. The drive motors 7 can be fitted to the eccentric bush 6 assigned to the respectively associated cylinder and coupled directly to the facing bearing journal 4 of the associated cylinder. However, it would also be conceivable to arrange the drive motors 7 in an axial offset manner with respect to the respectively associated cylinder, for reasons of space, and to fit the drive motors to the associated side wall 5 and to provide a drive connection to the associated cylinder via a short layshaft. In any case, the result, as compared with the conventional arrangements having a gear train which extends over all cylinders of the printing unit and is driven by an associated, comparatively large motor, is comparatively low rotating masses.

In order to reduce the size of the rotating masses further, the cylinders 2, 3 can be constructed as built-up cylinders, known per se, as indicated by the upper plate cylinder 3.

These cylinders each comprise a hollow centre part 8 formed by a tube, etc., which is accommodated on side flanges 9 which each contain a bearing journal 4.

By means of a control device, the drive motors can be regulated in terms of rotational speed and rotational angle and can thus be synchronized. The control device 10 contains controllers 11 which are assigned to the drive motors 7 and which are interlinked in the form of a cascade or the like so that the output variable from a reference controller functions as a reference variable for the controllers downstream.

In the event of a web break, the drive motors 7 and, with the latter, the cylinders 2, 3 driven by the motors, are braked to a standstill from the current rotational speed within one revolution or a few revolutions. To this end, there is stored in the control device 10, which can be constructed as a freely programmable control device, a control program which contains a steep emergency stop ramp which leads to a standstill within one revolution or at least within a few revolutions of the cylinder 2, 3, as indicated by using a curve 12 shown in a speed/time diagram.

In the event of a web break, the control device 10 receives a signal as indicated by an input arrow 13. This signal may come from a web break switch, as it is known, which may be constructed as a light barrier, for example. However, it would also be conceivable to monitor the current torque of the motors 7 and, in the event of a torque change characteristic of a web break, to generate the signal 13 and/or to activate the aforementioned control program containing the emergency stop ramp 12. As a result of activating the control program containing the emergency stop ramp 12, the motors 7 are driven in such a way that they are simultaneously braked to a standstill along the emergency stop ramp 12 within a few revolutions, that is to say abruptly.

This ensures that, in the event of a "winder", that is to say in the event of the printing-material web which has lost its tension as a result of the web break being wound up on a transfer cylinder 2, only one web layer or a few web layers are wound up before the machine stops. The cylinders 2, 3 can therefore remain in the print-on position or can be transferred slowly into the print-off position, without damage to the rubber blankets or rubber sleeves and/or the cylinder bearings having to be feared because of the winder. It is possible to dispense completely with cutting and/or catching devices for cutting or catching the torn printing-material web.

The emergency stop ramp 12 is designed so that a maximum of five revolutions is needed to brake the machine from full speed to a standstill. The aim should be one revolution or, in any case, less than two revolutions, and this is also possible in cases in which the normal operating speed is not too high.

In order to brake the motors 7, these are briefly overloaded. Accordingly, the emergency stop ramp runs in such a way that the motors 7 are operated in the overload range, at least for some time. This results in a particularly good braking action. The motors 7 are preferably constructed as induction motors, which are particularly insensitive to overloads. In order to achieve a particularly good braking action, the motors 7 are changed over to reverse for the purpose of braking. In this way, the effective direction of the motor torque is reversed and is therefore fully available as a braking torque.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. Method of preventing machine damage in the event of a web break in a web-fed rotary printing machine comprising a plurality of cylinders which, in a print-on position, roll one on another, said printing machine further comprising a plurality of drive motors for driving said cylinders, wherein each said cylinder is driven by a respective said drive motor, said method comprising synchronizing the motors so that they are all driven at the same speed, detecting when a web break occurs, and braking said drive motors to a standstill within five revolutions by reversing the effective direction of torque produced by the motors when a web break occurs.

2. Method according to claim 1 wherein said drive motors are braked to a standstill within two revolutions when a web break occurs.

3. Method as in claim 2 wherein said drive motors are braked to a standstill within one revolution when a web break occurs.

4. Method as in claim 1 wherein, during braking, said cylinders remain in the print-on position.

5. The method of claim 1 wherein said motors are induction motors, said motors being braked by overloading said motors.

6. Method according to claim 1 further comprising:

providing a control program having therein an emergency stop ramp which brakes said motors to a standstill within five revolutions when a web break is detected, and activating said control program when said web break is detected.

7. Apparatus for preventing machine damage in the event of a web break in a web-fed rotary printing machine having a plurality of cylinders which, in a print-on position, roll one on another, said printing machine further comprising a plurality of drive motors for driving said cylinders, wherein each said cylinder is driven by a respective said drive motor, said apparatus comprising a control device for synchronizing the motors so that they are all driven at the same speed, said control device having stored therein a control program which can be activated in the event of a web break, said control program having therein an emergency stop ramp which brakes said motors to a standstill within five revolutions, said program driving said motors along said stop ramp in the event of a web break.

8. Apparatus as in claim 7 wherein said each said cylinder is a built up cylinder having a hollow center part.

9. Apparatus as in claim 7 wherein each said drive motor is an induction motor.

10. Apparatus as in claim 7 wherein said control program drives motors along said stop ramp by operating said motors in the overload range.

11. Apparatus as in claim 7 wherein said control program brakes said motors by reversing the effective direction of torque produced by the motors.

12. Apparatus as in claim 7 wherein said control program brakes all of said motors to a standstill simultaneously.

13. Apparatus as in claim 7 wherein said control program brakes said motors to a standstill within two revolutions.

14. Apparatus as in claim 13 wherein said control program brakes said motors to a standstill within one revolution.

15. Method as in claim 1 comprising braking all of said drive motors to a standstill simultaneously when a web break occurs.

* * * * *